US007572194B2

(12) United States Patent
Yamamoto

(10) Patent No.: US 7,572,194 B2
(45) **Date of Patent: *Aug. 11, 2009**

(54) GOLF CLUB HEAD AND GOLF CLUB

(75) Inventor: Akio Yamamoto, Kobe (JP)

(73) Assignee: SRI Sports Limited, Kobe-Shi (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/219,808

(22) Filed: Jul. 29, 2008

(65) Prior Publication Data

US 2008/0293516 A1 Nov. 27, 2008

Related U.S. Application Data

(63) Continuation of application No. 11/488,830, filed on Jul. 19, 2006, now Pat. No. 7,462,110.

(30) Foreign Application Priority Data

Oct. 25, 2005 (JP) ..... 2005-309585

(51) Int. Cl.
*A63B 53/04* (2006.01)
*A63B 53/06* (2006.01)

(52) U.S. Cl. ..... 473/334; 473/338; 473/345; 473/349

(58) Field of Classification Search ..... 473/324–350, 473/287–292, 219–256
See application file for complete search history.

(56) References Cited

U.S. PATENT DOCUMENTS 985,194 A 2/1911 McLaren
1,133,129 A * 3/1915 Govan ..... 473/337
1,167,387 A 1/1916 Daniel
1,455,379 A 5/1923 Allen
1,840,924 A 1/1932 Tucker
1,913,821 A * 6/1933 Stumpf ..... 473/338
2,163,091 A 6/1939 Held
2,198,981 A * 4/1940 Sullivan ..... 473/338
2,715,026 A * 8/1955 Cadman ..... 473/334
3,143,349 A * 8/1964 MacIntyre ..... 473/338
3,743,297 A * 7/1973 Dennis ..... 473/242
4,052,075 A * 10/1977 Daly ..... 473/338
4,423,874 A 1/1984 Stuff, Jr.
4,607,846 A 8/1986 Perkins
4,695,054 A 9/1987 Tunstall
4,754,977 A 7/1988 Sahm
4,811,950 A 3/1989 Kobayashi et al.
5,244,210 A 9/1993 Au (Continued)

*Primary Examiner*—Sebastiano Passaniti
(74) *Attorney, Agent, or Firm*—Birch, Stewart, Kolasch & Birch, LLP

(57) ABSTRACT

A golf club head includes a recessed part on the external surface of a head main body, and a weight member mounted in this recessed part and formed of a material having a specific gravity greater than that of the head main body. This golf club head has a first addition member mounted on and abutting the external side of the weight member. A base of this first addition member is a resin or a rubber. The head has a second addition member mounted on and abutting the external side of the first addition member. This second addition member is formed of a metal having a specific gravity greater than that of the first addition member and smaller than that of the weight member. Therefore, the joint strength between the head main body and the weight member can be enhanced.

7 Claims, 8 Drawing Sheets

U.S. PATENT DOCUMENTS

| | | | | |
|---|---|---|---|---|
| 5,316,305 | A | | 5/1994 | McCabe |
| 5,571,053 | A | * | 11/1996 | Lane ..... 473/336 |
| 5,632,694 | A | * | 5/1997 | Lee ..... 473/336 |
| 6,062,988 | A | | 5/2000 | Yamamoto |
| 6,379,265 | B1 | | 4/2002 | Hirakawa et al. |
| 6,991,558 | B2 | | 1/2006 | Beach et al. |
| 2005/0096151 | A1 | | 5/2005 | Hou et al. |
| 2006/0100029 | A1 | | 5/2006 | Lo |
| 2006/0258480 | A1 | | 11/2006 | Hou et al. |
| 2007/0129160 | A1 | | 6/2007 | Matsunaga et al. |

* cited by examiner

GOLF CLUB HEAD AND GOLF CLUB

This application is a Continuation of application Ser. No. 11/488,830 filed on Jul. 19, 2006 now U.S. Pat. No. 7,462,110, which claims priority on Japanese Patent Application No. 2005-309585 filed on Oct. 25, 2005, the entire contents of which are hereby incorporated by reference and for which priority is claimed under 35 U.S.C. § 120.

BACKGROUND OF THE INVENTION

1. Field of the Invention

The present invention relates to a golf club head and a golf club.

2. Description of the Related Art

Performances of golf club heads vary depending on the weight distribution in the head. Effective means for improving the control performances and flight distance performances include lowering of the center of gravity, deepening of the center of gravity, and increase in moment of inertia, and the like.

In attempts of lowering the center of gravity, deepening the center of gravity, and increasing the moment of inertia, a weight member having a specific gravity greater than that of the head main body may be used. Because this weight member has a specific gravity greater than that of the head main body, the degree of freedom in regulating the weight distribution in the head can be elevated. Also, when the weight member is exposed, the presence of the weight member may be visually perceptible. The exposed weight member can make an appeal to golf players for the excellent head performances.

The weight member is provided as a separate member from the head main body. The weight member is attached to the head main body. Upon hitting, the weight member receives a great impact. The weight member must be firmly attached to the head main body. JP-A No. 2000-176059 discloses a technique for engaging the head main body with the weight member by means of an undercut part or a circumferential groove. A USA counterpart to the JP-A No. 2000-176059 is U.S. Pat. No. 6,379,265.

In the aforementioned prior art technique, the weight member is press fitted into the head main body. Upon the press fitting, strong force is imparted to the boundary part between the weight member and the head main body. The press fitting may partially deform the boundary part between the head main body and the weight member, or may readily yield a nonuniform gap between the head main body and the weight member in the boundary part. The press fitting may readily deteriorate the good-looking appearance of the boundary part between the head main body and the weight member.

As other technique for joint, welding of the head main body and the weight member may be suggested. In case of the welding, nonuniform weld bead, traces of the polishing thereof and the like are apt to be provided. In such cases of the welding, good-looking appearance of the boundary part between the head main body and the weight member may be readily deteriorated.

As other technique for the joint, screw cramping of the head main body with the weight member may be suggested. In case of the screw cramping, likelihood of detachment of the weight member due to repeated impact is comparatively greater than that in cases of other joining processes. Interpositioning of an engaging member between the head main body and the weight member may also be suggested. When the engaging member is interpositioned, the structure is apt to be complicated, and may result in elevation of the cost for the members, and for production of the head.

SUMMARY OF THE INVENTION

The golf club head of the present invention has a head main body provided with a recessed part on the external surface thereof; a weight member which is mounted in this recessed part and which is formed of a material having a specific gravity greater than that of the head main body; and a first addition member mounted on the external side of the weight member while abutting the external surface of this weight member, a base of the first addition member being a resin or a rubber.

Preferably, the golf club head has a second addition member mounted on the external side of the first addition member while abutting the external surface of the first addition member. Preferably, this second addition member is formed of a metal, with the specific gravity of this metal being greater than that of the first addition member and smaller than that of the weight member.

According to the present invention, joint strength between the head main body and the weight member can be increased, and the good-looking appearance can be improved.

The first addition member covers at least a part of the weight member. The first addition member can improve the good-looking appearance of the head. The first addition member does not inhibit the joint between the weight member and the head main body. According to the constitution of the present invention, a structure with great joint strength is permitted.

DESCRIPTION OF THE PREFERRED EMBODIMENTS

Hereinafter, the present invention will be explained in detail by way of preferred embodiments with appropriate reference to the accompanying drawings.

Figure 1:
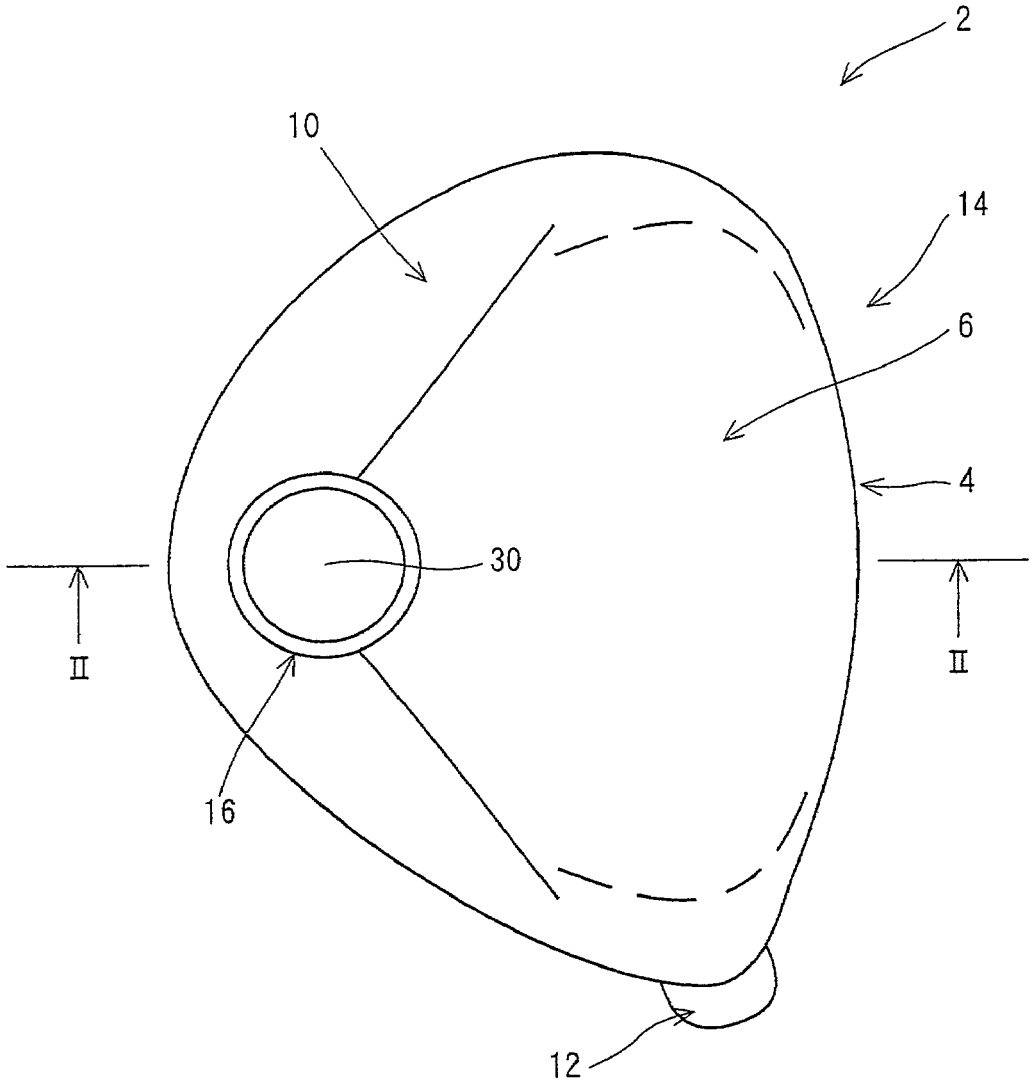
FIG. 1 is a drawing of a golf club head according to a first embodiment of the present invention viewed from the sole side.
Figure 2:
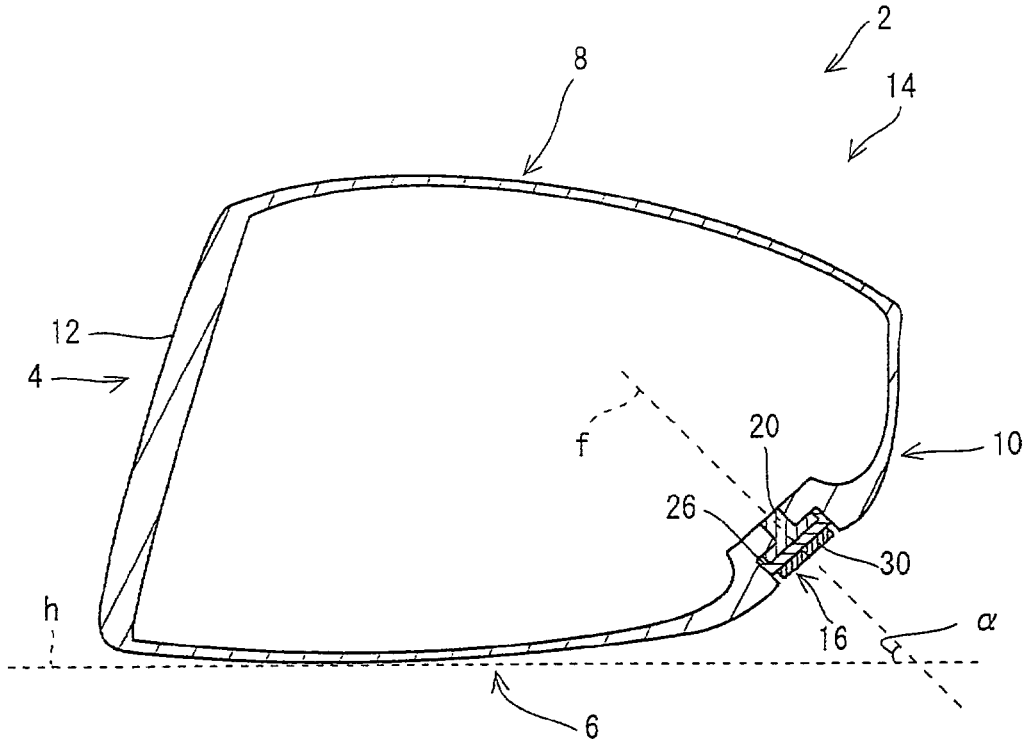
FIG. 2 is a cross-sectional view taken along a line II-II of FIG. 1.

As shown in FIG. 1 and FIG. 2, the head 2 has a head main body 14. The head main body 14 constitutes a large part of the head 2. The head main body 14 has a face member 4, a sole member 6, a crown member 8, a side member 10, and a hosel member 12. The face member 4 constitutes the front face of the head 2. The crown member 8 constitutes the upper surface of the head 2. The sole member 6 constitutes the inferior surface of the head 2. The face member 4 extends between the front side edge of the crown member 8 and the front side edge of the sole member 6. The side member 10 constitutes a part other than the face member 4 in the part that extends between the edge of the crown member 8 and the edge of the sole member 6. Upon impact, the external surface of the face member 4, i.e., the face surface 12 is brought into contact with the golf ball. The hosel member 12 has a shaft hole although not shown in the Figure. Into this shaft hole is inserted and attached the tip part of the golf club shaft.

As shown in FIG. 2, the head 2 has a hollow structure. The head main body 14 is formed of a metal such as e.g., titanium alloy or the like. The head main body 14 may also be constituted by, for example, welding a multiple number of metal members. The head main body 14 may also be produced with CFRP (carbon fiber reinforced plastic). The head main body 14 may also be produced through combining CFRP (carbon fiber reinforced plastic) with a metal. Illustrative examples of the material for the head main body 14 include titanium alloys, CFRPs (carbon fiber reinforced plastics), magnesium alloys, aluminum alloys, stainless alloys, maraging steels and the like.

The head main body 14 has a recessed part 16. The recessed part 16 is provided on the external surface of the head main body 14. As shown in FIG. 1, the recessed part 16 has an external margin being substantially circular. A through-hole 18 is provided at the bottom face of the recessed part 16 (see, FIG. 3). The recessed part 16 is positioned on the rear of the head main body 14. The recessed part 16 is positioned on the boundary part between the side member 10 and the sole member 6 of the head 2.

The head 2 has a weight member 20. The weight member 20 is mounted inside of the recessed part 16. The weight member 20 has a specific gravity being greater than that of the head main body 14. Illustrative examples of the material of the weight member 20 include tungsten, tungsten alloys, W—Ni (tungsten-nickel) alloys, W—Cu (tungsten-copper) alloys and the like. The weight member 20 having a great specific gravity may improve the design freedom of the weight distribution in the head 2. By mounting the weight member 20 on the rear of the head, the depth of the center of gravity of the head 2 can be increased. By mounting the weight member 20 on the sole member 6 or closer to the sole member 6, height of the center of gravity of the head 2 can be decreased.

Figure 3:
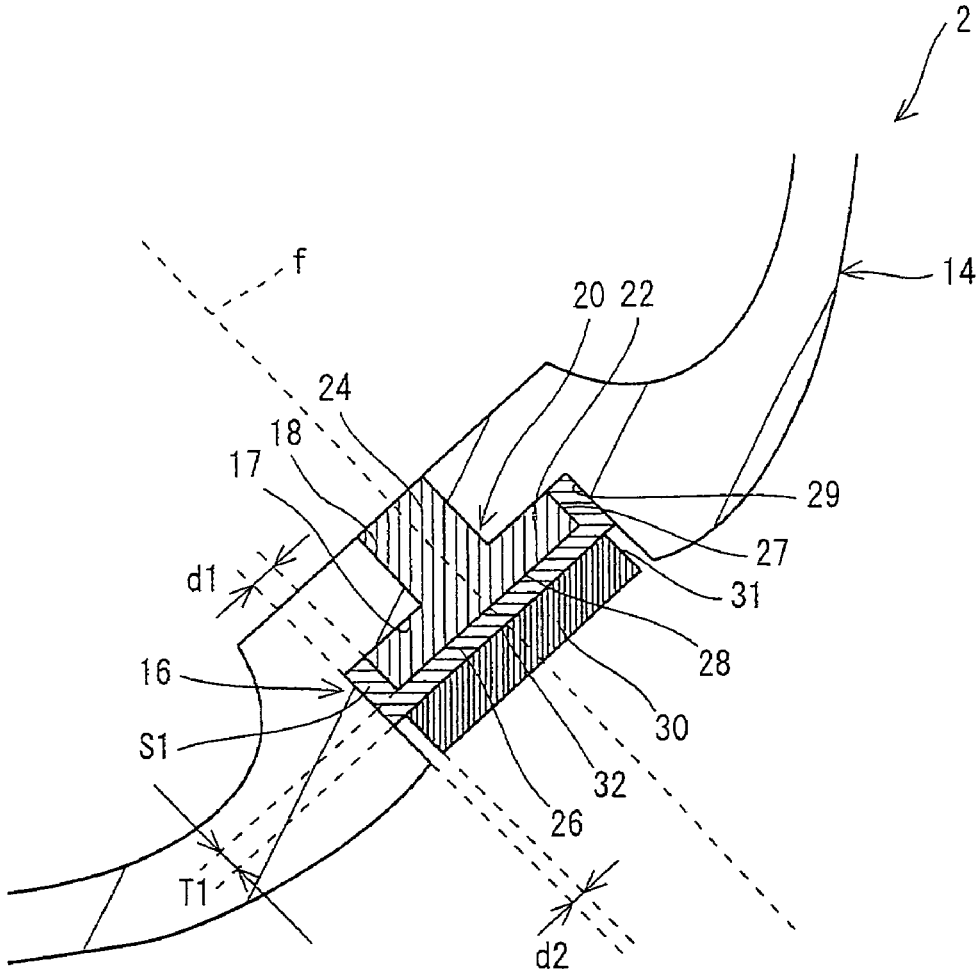
FIG. 3 is an enlarged cross-sectional view showing the recessed part shown in FIG. 2 and therearound.

FIG. 3 is an enlarged cross-sectional view of the head main body 14 and therearound in the head 2. The shape of the weight member 20 substantially corresponds to the shape of the recessed part 16. The weight member 20 has a basal part 22, and a projecting part 24 protruded from the basal part 22. The basal part 22 has a substantially discoid shape. The projecting part 24 has a cross-sectional shape that is substantially the same as the cross-sectional shape of the through-hole 18.

There exists a gap S1 having a gap width d1 between the lateral face 27 of the basal part 22 and the recessed part 16 (see, FIG. 3). The weight member 20 has a lateral face 27 that does not abut the head main body 14. As described later, this gap S1 is filled with an adhesive.

The weight member 20 is fixed to the head main body 14 by a fixing means. Illustrative examples of this fixing means include physical fixing means, and fixing means by way of an adhesive. Illustrative examples of the physical fixing means include fixation by plastic deformation or screw structures. Illustrative examples of the fixation by plastic deformation may include constructions in which the projecting part 24 is press fitted into the through-hole 18. Illustrative examples of the construction of the fixation by a screw structure include engagement of the through-hole 18 with the projecting part 24 by a screw structure. Although not shown in FIG. 3, in case of the engagement by a screw structure, for example, the inner face of the through-hole 18 is disposed as the internal thread, while the projecting part 24 is disposed as the external thread. In light of the binding strength, the fixing means for allowing the weight member 20 to fix to the head main body 14 preferably includes the physical fixing means.

The head 2 has a first addition member 26. The first addition member 26 abuts the external surface 28 of the weight member 20 (see, FIG. 3). The first addition member 26 covers at least a part of the weight member 20. The first addition member 26 is mounted on the external side of the weight member 20. The first addition member 26 is layered.

A base of the first addition member 26 is a resin or a rubber. The first addition member 26 may be formed of an adhesive including a resin or a rubber as a base. The first addition member 26 may be a member formed by applying a material including a resin or a rubber as a base to a basal part such as paper or the like. The first addition member 26 may also be an adhesive tape such as a double-stick tape or the like. The first addition member 26 may also be one provided by applying in a flowable state to the external surface of the weight member 20. The first addition member 26 may be mounted on the external surface of the weight member 20 by previously molding.

The first addition member 26 may be formed with multiple materials. The first addition member 26 may be either monolayered, or multilayered. In the embodiment shown in FIG. 3, the first addition member 26 is formed of a single material. In the embodiment shown in FIG. 3, the first addition member 26 is monolayered. In the embodiment shown in FIG. 3, the first addition member 26 is an adhesive. The aforementioned gap S1 is filled with a first addition member 26. The first addition member 26 covers the external side and the lateral face of the weight member 20.

The head 2 has a second addition member 30. The second addition member 30 abuts the external surface 32 of the first addition member 26. The second addition member 30 is mounted on the external side of the first addition member 26. The second addition member 30 covers at least a part of the first addition member 26. The lateral face 31 of the second addition member does not abut the lateral face 29 of the head main body 14.

The second addition member 30 has a specific gravity greater than that of the first addition member 26. The second addition member 30 has a specific gravity smaller than that of the weight member 20. The second addition member 30 is formed of a metal. Typical second addition member 30 is a badge made of a metal, or a metallic plate. The badges made of a metal and plates made of a metal may be excellent in good-looking appearance. On the badges made of a metal and metallic plates can be put logos for indicating the trade name, trade mark and the like. The second addition member 30 made of a metal can be readily mounted. The second addition member 30 is adhered to the weight member 20 via the first addition member 26 being an adhesive.

Figure 4:
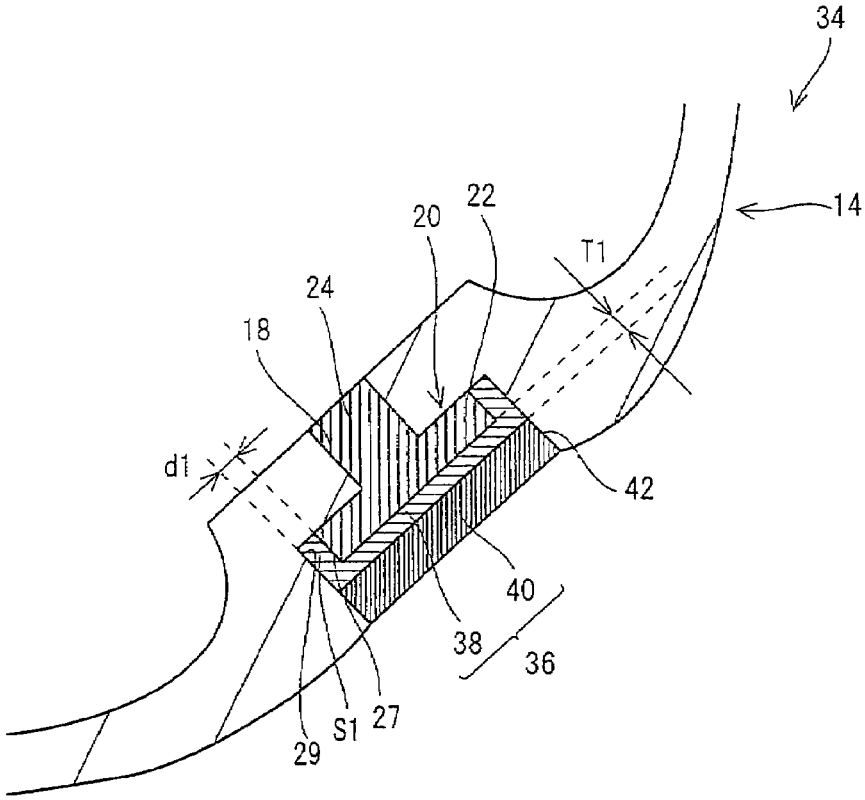
FIG. 4 is an enlarged cross-sectional view showing the recessed part and therearound of the golf club head according to a second embodiment of the present invention.

FIG. 4 is a cross-sectional view of a head 34 according to the second embodiment of the present invention. The structure of the head main body and the weight member in the head 34 is identical to the head main body 14 shown in FIG. 3. Therefore, explanation of the head main body 14 and the weight member 20 will be optionally omitted while referring to the same reference signs as those in the head 2.

The first addition member 36 of the head 34 is constituted of two members. The first addition member 36 is constituted of an adhesive layer 38 and a urethane resin member 40. The urethane resin member 40 is a member having a discoid shape. Similarly to the head 2 as described above, the adhesive layer 38 is present in the gap S1 between the lateral face 27 of the weight member 20 and the lateral face 29 of the head main body 14. The first addition member 36 has a two-layer structure. The urethane resin member 40 is formed of a resin including a urethane resin as a base. The urethane resin member 40 is exposed. The exposed urethane resin member 40 can be formed into, for example, a badge. The badge exhibits an excellent good-looking appearance. On the badge can be put logos or letters for indicating the trade name and the like. The urethane resin member 40 is adhered to the weight member 20 via the adhesive layer 38. There is no gap between the lateral face 29 of the head main body 14 and the lateral face 42 of the urethane resin member 40. The lateral face 42 of the urethane resin member 40 abuts the lateral face 29 of the head main body 14.

Figure 5:
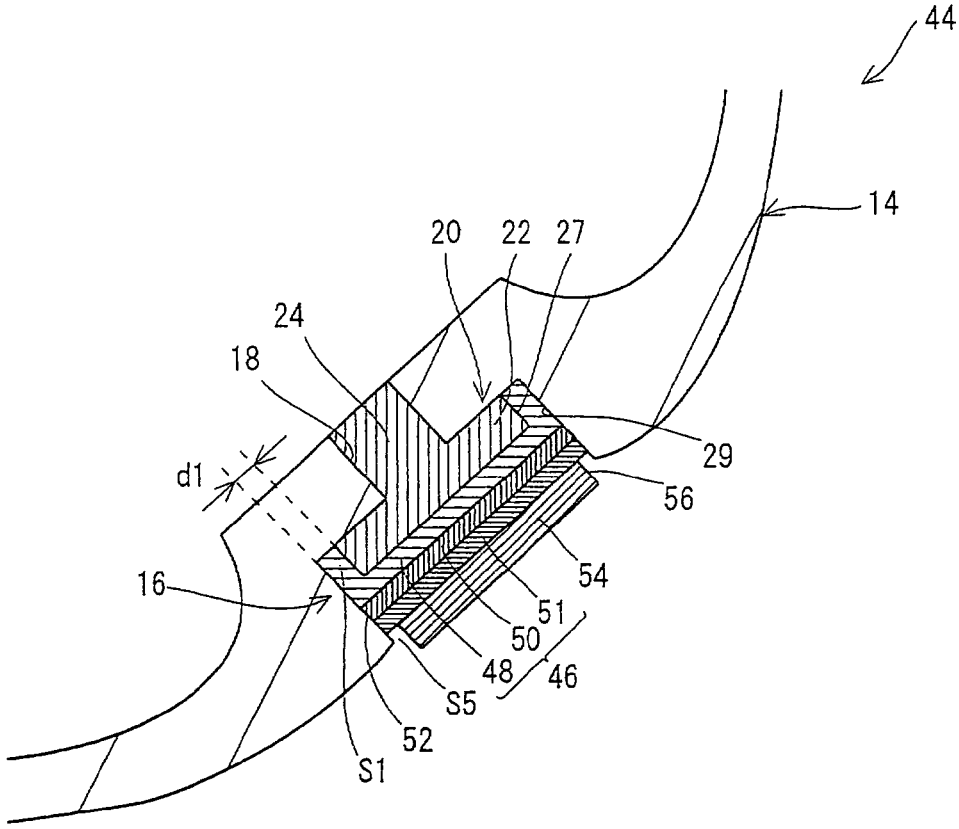
FIG. 5 is an enlarged cross-sectional view showing the recessed part and therearound of the golf club head according to a third embodiment of the present invention.

FIG. 5 is a cross-sectional view of a head 44 according to the third embodiment of the present invention. The structure of the head main body and the weight member in the head 44 is identical to the head main body 14 shown in FIG. 3. Therefore, explanation of the head main body 14 and the weight member 20 will be optionally omitted while referring to the same reference signs as those in the head 2.

The first addition member 46 of the head 44 is constituted of three members. The first addition member 46 is constituted of a first adhesive layer 48, a urethane resin member 50 and a second adhesive layer 51. The urethane resin member 50 is a member having a discoid shape. Similarly to the head 2 as described above, the first adhesive layer 48 extends in the gap S1 between the lateral face 27 of the weight member 20 and the lateral face 29 of the head main body 14. The first addition member 46 has a three-layer structure. The urethane resin member 50 is formed of a resin including a urethane resin as abase. The urethane resin member 50 may be, for example, a plate member formed of a urethane resin. The urethane resin member 50 is adhered to the weight member 20 via the first adhesive layer 48.

A second addition member 54 is mounted on the external side of the second adhesive layer 51. The second addition member 54 abuts the external surface of the second adhesive layer 51. The second addition member 54 is adhered to the urethane resin member 50 via the second adhesive layer 51. The second addition member 54 covers at least a part of the second adhesive layer 51.

The second addition member 54 is a member having a discoid shape. The second addition member 54 is made of a metal. The second addition member 54 has a specific gravity greater than that of the first addition member 46. The second addition member 54 has a specific gravity smaller than that of the weight member 20. Typical second addition member 54 is a badge made of a metal, or a metallic plate. The badges made of a metal and plates made of a metal may be excellent in good-looking appearance. On the badges made of a metal and metallic plates can be put logos for indicating the trade name, trade mark and the like. The second addition member 54 made of a metal can be readily mounted.

A gap S5 is present between the lateral face 56 of the second addition member 54 and the lateral face 29 of the head main body 14. The lateral face 56 of the second addition member 54 is not in contact with the lateral face 29 of the head main body 14. The lateral face 56 of the second addition member 54 is not in contact with the head main body 14.

Figure 6:
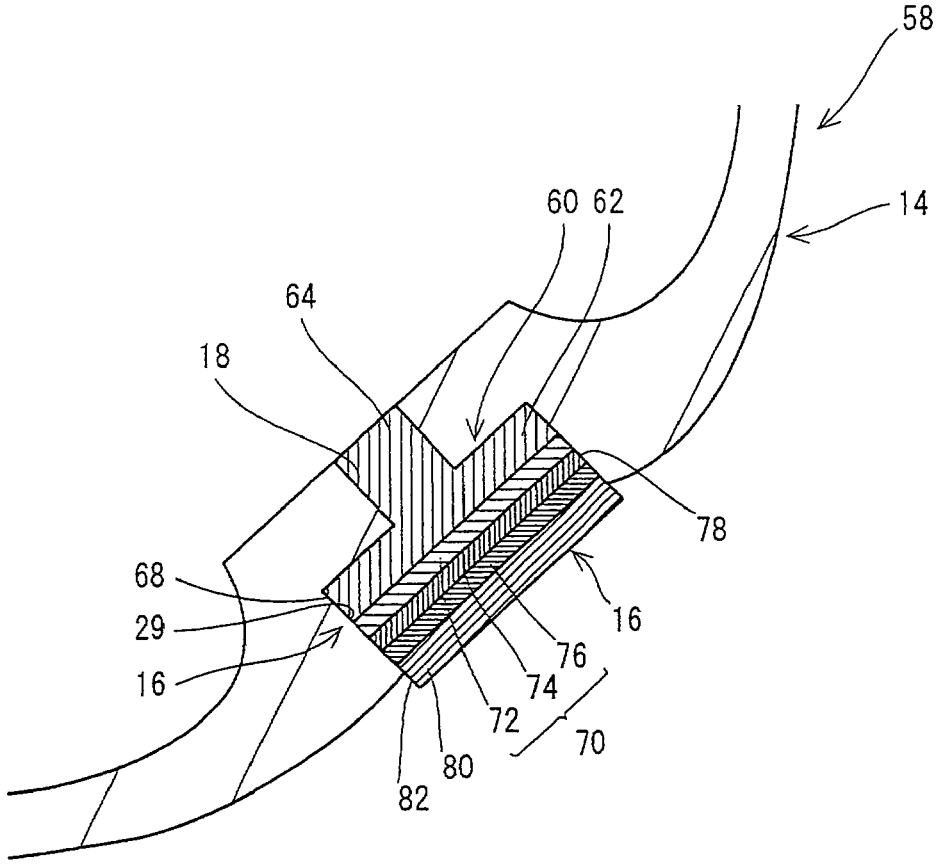
FIG. 6 is an enlarged cross-sectional view showing the recessed part and therearound of the golf club head according to a fourth embodiment of the present invention.

FIG. 6 is a cross-sectional view of a head 58 according to the fourth embodiment of the present invention. The structure of the head main body in the head 58 is identical to the head main body 14 shown in FIG. 3. Therefore, explanation of the head main body 14 will be optionally omitted while referring to the same reference signs as those in the head 2.

The weight member 60 of the head 58 has a basal part 62, and a projecting part 64 protruded from the basal part 62. The basal part 62 has a substantially discoid shape. The projecting part 64 has a cross-sectional shape that is substantially the same as the cross-sectional shape of the through-hole 18.

There is no gap present between the lateral face 66 of the basal part 62 and the recessed part 16. The basal part 62 has an external diameter approximately equal to the internal diameter of the recessed part 16.

The first addition member 70 of the head 58 is constituted of three members. The first addition member 70 is constituted of a first adhesive layer 72, a urethane resin member 74 and a second adhesive layer 76. The urethane resin member 74 is a member having a discoid shape. The lateral face 78 of the urethane resin member 74 abuts the lateral face 29 of the head main body 14. There is substantially no gap present between the lateral face 78 of the urethane resin member 74 and the lateral face 29 of the head main body 14. The first addition member 70 has a three-layer structure. The first addition member 70 is formed of a resin including a urethane resin as a base. The urethane resin member 74 is adhered to the weight member 60 via the first adhesive layer 72.

A second adhesive layer 76 is provided on the external surface of the urethane resin member 74. The second addition member 80 abuts the external surface of the second adhesive layer 76. The second addition member 80 is adhered to the urethane resin member 74 via the second adhesive layer 76. The second addition member 80 covers at least a part of the second adhesive layer 76.

The second addition member 80 is a member having a discoid shape. The second addition member 80 is made of a metal. The second addition member 80 has a specific gravity greater than that of the first addition member 70. The second addition member 80 has a specific gravity smaller than that of the weight member 60. Typical second addition member 80 is a badge made of a metal, or a metallic plate. The badges made of a metal and plates made of a metal may be excellent in good-looking appearance. On the badges made of a metal and metallic plates can be put logos for indicating the trade name, trade mark and the like. The second addition member 80 made of a metal can be readily mounted.

There is substantially no gap present between the lateral face 82 of the second addition member 80 and the lateral face 29 of the head main body 14. The lateral face 82 of the second addition member 80 is in contact with the lateral face 29 of the head main body 14. The second addition member 80 is in contact with the head main body 14.

Figure 7:
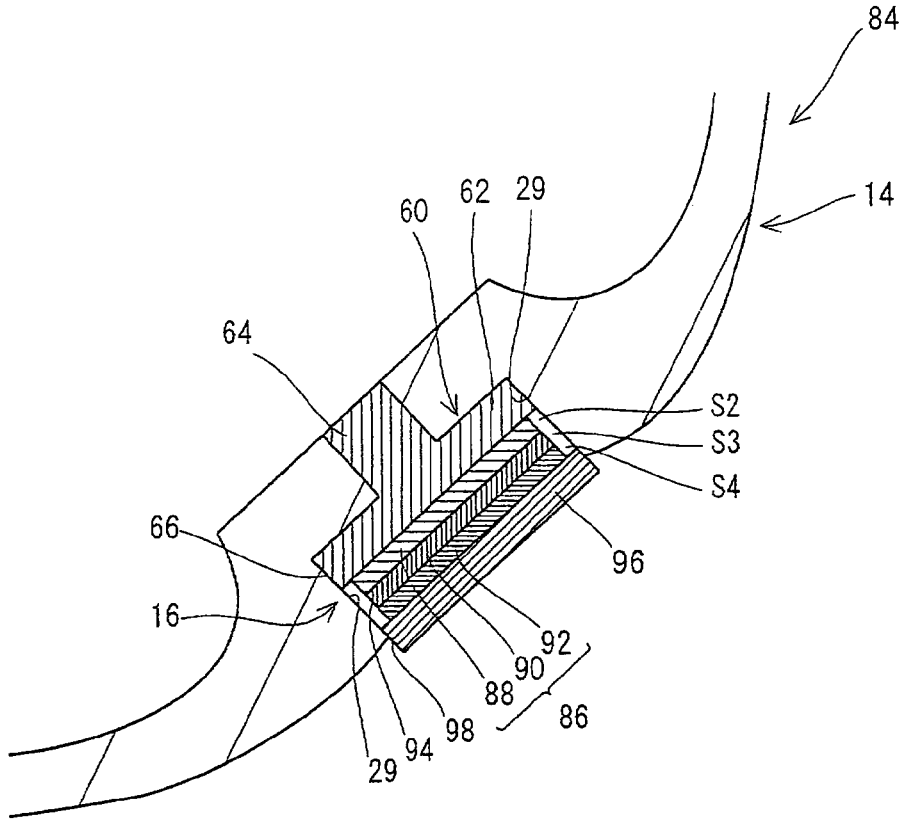
FIG. 7 is an enlarged cross-sectional view showing the recessed part and therearound of the golf club head according to a fifth embodiment of the present invention.

FIG. 7 is a cross-sectional view of a head 84 according to the fifth embodiment of the present invention. The structure of the head main body and the weight member in the head 84 is identical to the head 58 shown in FIG. 6. Therefore, explanation of the head main body 14 and the weight member 60 will be optionally omitted while referring to the same reference signs as those in the head 58.

The weight member 60 of the head 84 has a basal part 62, and a projecting part 64 protruded from the basal part 62. The basal part 62 has a substantially discoid shape. The projecting part 64 has a cross-sectional shape that is substantially the same as the cross-sectional shape of the through-hole 18. There is no gap present between the lateral face 66 of the basal part 62 and the lateral face 29 of the recessed part 16. The basal part 62 has an external diameter approximately equal to the internal diameter of the recessed part 16.

The first addition member 86 of the head 84 is constituted of three members. The first addition member 86 is constituted of a first adhesive layer 88, a urethane resin member 90 and a second adhesive layer 92. The urethane resin member 90 is a member having a discoid shape. The first adhesive layer 88 has substantially the same shape to that of the urethane resin member 90. A gap S2 is present between the first adhesive layer 88 and the lateral face 29 of the head main body 14. A gap S3 is present between the lateral face 94 of the urethane resin member 90 and the lateral face 29 of the head main body 14. The first addition member 86 has a three-layer structure. The urethane resin member 90 is formed of a resin including a urethane resin as a base. The urethane resin member 90 is adhered to the weight member 60 via the first adhesive layer 88.

On the external surface of the urethane resin member 90 is provided a second adhesive layer 92. A gap S4 is present between the lateral face of the second adhesive layer 92 and the lateral face 29 of the head main body 14.

The second addition member 96 is adhered to the urethane resin member 90 via the second adhesive layer 92. The second addition member 96 abuts the external surface of the second adhesive layer 92. The second addition member 96 covers the entire second adhesive layer 92.

The second addition member 96 is a member having a discoid shape. The second addition member 96 is made of a metal. The second addition member 96 has a specific gravity greater than that of the first addition member 86. The second addition member 96 has a specific gravity smaller than that of the weight member 60. Typical second addition member 96 is a badge made of a metal, or a metallic plate. The badges made of a metal and plates made of a metal may be excellent in good-looking appearance. On the badges made of a metal and metallic plates can be put logos for indicating the trade name, trade mark and the like. The second addition member 96 made of a metal can be readily mounted. There is substantially no gap present between the lateral face 98 of the second addition member 96 and the lateral face 29 of the head main body 14. The lateral face 98 of the second addition member 96 abuts the lateral face 29 of the head main body 14. The second addition member 96 abuts the head main body 14.

Because the weight member is provided as a separate member from the head main body, it can be detached from the head main body. Vibration upon impact can cause the weight member to vibrate. Because the weight member has a specific gravity greater than that of the head main body, it is apt to be vibrated. The weight member is apt to correspond to the vibration antinode, and thus, the displacement magnitude upon the vibration is liable to be great. In order to inhibit the detachment of the weight member, it is desired to suppress the vibration of the weight member. Because the first addition member abuts the weight member, vibration of the weight member can be suppressed. Since the first addition member is formed of a material including a resin or a rubber as a base, an excellent vibration suppressing effect may be exerted. The material including a resin or a rubber as a base has viscoelasticity. The material having viscoelasticity exhibits an excellent vibration suppressing effect.

Because the first addition member is provided on the external side of the weight member, it masks at least a part of the weight member. The first addition member improves the good-looking appearance more favorably than the weight member. Examples of the first addition member with good-looking appearance include, for example, badges formed of a resin.

The first addition member may involve either a single member or multiple members. The first addition member may be either single-layered, or multiple-layered. As in the embodiment described above, the first addition member may include any of one layer, two layers, three layers, or four or more layers. When the first addition member includes two layers, it is preferred that the adhesive and the resin member be alternately mounted in the first addition member. By thus mounting alternately, fixation of the first addition member is facilitated.

Illustrative examples of the adhesive constituting the first addition member include urethane based adhesive, epoxy based adhesives, acrylic adhesives, and the like. In cases in which the second addition member is provided, an epoxy based adhesive is preferred. Because the epoxy based adhesive has appropriate rigidity, excessive vibration of the second addition member can be suppressed. Suppression of the excessive vibration may result in prevention of detachment of the second addition member.

Illustrative examples of the material for the first addition member include resins and rubbers other than the adhesives as described above. Examples of the resin include thermoplastic resins and thermosetting resins. Illustrative examples of the rubber include vulcanized rubbers. Illustrative examples of the vulcanized rubber include butadiene rubbers, natural rubbers, SBR and the like. Illustrative examples of the thermoplastic resin include urethane resins and epoxy resins. The material of the first addition member may be any one in which the aforementioned resin or rubber is included as the base to which various additives, filler and the like are blended.

Preferable material of the second addition member may be a metal. The metal is excellent in the scuff resistance, weather resistance, color fastness and processibility. The second addition member made of a metal masks the weight member, and can improve the appearance of the head. In light of achievement of favorable good-looking appearance and suitable specific gravity, the material of the second addition member is preferably aluminum or an aluminum alloy. A covering layer may also be provided which covers the metal external surface of the second addition member. The covering layer can be a plated layer, a vapor deposited layer or the like.

As described above, for suppressing the vibration of the weight member, the first addition member formed of a material including a resin or a rubber as a base is desirably provided. By improving the effect of suppressing the vibration of the weight member (hereinafter, may also be merely referred to as vibration suppressing effect), inferior fixation (loose) of the weight member and detachment of the weight member can be inhibited.

In light of improvement of the vibration suppressing effect, the first addition member has a thickness T1 of equal to or greater than 0.02 mm, more preferably equal to or greater than 0.04 mm, and particularly preferably equal to or greater than 0.05 mm. In light of suppression of excessive increase in the weight of the first addition member to improve the design freedom of the weight distribution in the head, the first addition member has a thickness T1 of preferably equal to or less than 4.5 mm, and more preferably equal to or less than 4 mm.

In light of improvement of the vibration suppressing effect, the first addition member has a weight W1 of equal to or greater than 0.1 g, more preferably equal to or greater than 0.15 g, and particularly preferably equal to or greater than 0.2 g. In light of suppression of excessive increase in the weight of the first addition member to improve the design freedom of the weight distribution in the head, the first addition member has a weight W1 of equal to or less than 4 g, and more preferably equal to or less than 3 g.

It is preferred that the second addition member be provided separately from the first addition member. The specific gravity of the second addition member is greater than the specific gravity of the first addition member, and is smaller than the specific gravity of the weight member. Addition of the second addition member enlarges the range of the frequency domain of the vibration which can be suppressed, in comparison with the cases including the first addition member alone. Also, the presence of the second addition member leads to increase in the vibration of the first addition member, thereby increasing the energy loss by the first addition member. The increase in the energy loss may improve the vibration suppressing effect. Owing to the first addition member, the vibration of the weight member can be effectively absorbed. This vibration absorbing effect is improved by the presence of the second addition member. Owing to the vibration absorbing effect of the first addition member or the second addition member, the feel at impact can be improved.

In light of prevention of deformation upon hitting against a foreign substance or the like, the second addition member has a thickness T2 of preferably equal to or greater than 0.5 mm, more preferably equal to or greater than 0.7 mm, and particularly preferably equal to or greater than 1.0 mm. In light of improvement of the design freedom of the head, the second addition member has a thickness T2 of preferably equal to or less than 2.5 mm, more preferably equal to or less than 2.2 mm, and particularly preferably equal to or less than 1.8 mm.

In light of prevention of deformation upon hitting against a foreign substance or the like, the second addition member has a weight W2 of preferably equal to or greater than 0.5 g, more preferably equal to or greater than 0.7 g, and particularly preferably equal to or greater than 1.0 g. In light of improvement of the design freedom of the head, and inhibition of the detachment of the second addition member, the second addition member has a weight W2 of equal to or less than 4 g, more preferably equal to or less than 3.5 g, and particularly preferably equal to or less than 3 g.

In light of improvement of the design freedom of the weight distribution in the head, the weight member has a weight W3 of preferably equal to or greater than 2 g, more preferably equal to or greater than 4 g, and particularly preferably equal to or greater than 6 g. In light of securement of the strength of the head main body by increasing the weight distributed to the head main body, the weight member has a weight W3 of preferably equal to or less than 20 g, more preferably equal to or less than 17 g, and particularly preferably equal to or less than 14 g.

In light of improvement of the design freedom of the weight distribution in the head, the weight member has a specific gravity of preferably equal to or greater than 10, more preferably equal to or greater than 12, and particularly preferably equal to or greater than 14. In light of ready availability of the material and capability of formation of the weight member, the weight member has a specific gravity of preferably equal to or less than 18, and more preferably equal to or less than 17.

In light of improvement of the strength of the head main body, the head main body has a specific gravity of preferably equal to or greater than 1. In light of improvement of design freedom of the weight distribution in the head by the weight member, the head main body has a specific gravity of preferably equal to or less than 8, more preferably equal to or less than 5, and particularly preferably equal to or less than 3.

In light of inhibition of the detachment of the second addition member, the second addition member has a specific gravity being smaller than the specific gravity of the first addition member, and more preferably smaller than the specific gravity of the head main body. In light of inhibition of the detachment of the second addition member, the second addition member has a specific gravity of preferably equal to or less than 4, more preferably equal to or less than 3.5, and particularly preferably equal to or less than 3.

In light of improvement of the directionality of the hit ball, the head volume V is preferably equal to or greater than 150 cc, more preferably equal to or greater than 180 cc, and particularly preferably equal to or greater than 200 cc. In light of securement of the weight distributed to the weight member to improve the design freedom of the head, the head volume V is preferably equal to or less than 500 cc, more preferably equal to or less than 480 cc, and particularly preferably equal to or less than 460 cc.

In light of accomplishment of appropriate club balance, the head weight Wh is preferably equal to or greater than 180 g, more preferably equal to or greater than 185 g, and particularly preferably equal to or greater than 190 g. In light of accomplishment of appropriate club balance, the head weight Wh is preferably equal to or less than 230 g, more preferably equal to or less than 220 g, and particularly preferably equal to or less than 210 g.

In light of selection of a material exhibiting a favorable vibration suppressing effect and vibration absorbing effect, the first addition member has a specific gravity C1 of preferably equal to or greater than 1, more preferably equal to or greater than 1.1, and particularly preferably equal to or greater than 1.2. In light of selection of a material exhibiting a favorable vibration suppressing effect and vibration absorbing effect, the first addition member has a specific gravity C1 of preferably equal to or less than 3, more preferably equal to or less than 2.7, and particularly preferably equal to or less than 2.5.

In light of improvement of the vibration suppressing effect and vibration absorbing effect, it is preferred that the first addition member be in contact with the head main body. Because the first addition member includes a resin or a rubber as a base, such contact with the head main body may lead to suppression or absorption of the vibration of the head main body in an efficacious manner. In light of improvement of the vibration suppressing effect and vibration absorbing effect, it is preferred that the second addition member be not in contact with the head main body. By providing a given gap between the second addition member and the head main body, degree of freedom of the displacement of the second addition member is elevated, thereby resulting in enhanced vibration suppressing effect and vibration absorbing effect.

The gap width d2 between the lateral face of the second addition member and the lateral face of the head main body (see, FIG. 3) is preferably equal to or greater than 0.3 mm, more preferably equal to or greater than 0.5 mm, and particularly preferably equal to or greater than 0.7 mm. As the gap width d2 becomes greater, degree of freedom of the displacement of the second addition member is increased, thereby resulting in enhanced vibration absorbing effect by the first addition member and the second addition member. In light of improvement of the masking property against the first addition member or the weight member to improve the appearance of the head, the gap width d2 is preferably equal to or less than 1.5 mm, more preferably equal to or less than 1.2 mm, and particularly preferably equal to or less than 1.0 mm.

In each embodiment described above, the surface of the recessed part 16 in the head main body 14 involves a face that is approximately in parallel to the in-depth direction f of the recessed part 16 (see, FIG. 3), and a face that is approximately in perpendicular to the in-depth direction f. The face that is approximately in parallel to the in-depth direction f of the recessed part 16 includes the inner face of the through-hole 18, and the lateral face 29. The face that is approximately in perpendicular to the in-depth direction f of the recessed part 16 is the bottom face 17 of the recessed part 16 (see, FIG. 3). These faces can be the joint face where the head main body joins with the weight member.

According to impact upon hitting, the weight member is subjected to acceleration in a direction that is approximately in parallel to the horizontal plane h. This acceleration imparts a stress to the weight member in a direction that is approximately in parallel to the horizontal plane h. The stress that is approximately in parallel to the in-depth direction f imparts a concentrated shear stress to the joint face that is approximately in parallel to the in-depth direction f. Furthermore, the stress that is approximately in parallel to the in-depth direction f imparts a concentrated compression stress or tensile stress to the joint face that is approximately in perpendicular to the in-depth direction f. To the contrary, the stress that is approximately in perpendicular to the in-depth direction f imparts a concentrated shear stress to the joint face that is approximately in perpendicular to the in-depth direction f. Moreover, the stress that is approximately in perpendicular to the in-depth direction f imparts a concentrated compression stress or tensile stress to the joint face that is approximately in parallel to the in-depth direction f. In order to avoid the stress concentration toward the joint face, it is preferred that the horizontal plane h is not in parallel to the in-depth direction f. Moreover, in order to avoid the stress concentration toward the joint face, it is preferred that the horizontal plane h is not in perpendicular to the grounding plane g. In light of avoidance of the parallel positioning of the horizontal plane h to the in-depth direction f to allow the stress that acts on the joint face to disperse, the angle $\alpha$ formed by the intersection of the in-depth direction f of the recessed part 16 with the horizontal plane h in the head reference state (see, FIG. 2) is preferably equal to or greater than 10 degree, more preferably equal to or greater than 20 degree, and particularly preferably equal to or greater than 30 degree. In light of avoidance of the perpendicular positioning of the horizontal plane h to the in-depth direction f to allow the stress that acts on the joint face to disperse, the angle $\alpha$ is preferably equal to or less than 80 degree, more preferably equal to or less than 70 degree, and particularly preferably equal to or less than 60 degree.

The head reference state referred to herein means a state in which the head is placed on the horizontal plane h with a predetermined lie angle and hook angle.

EXAMPLES

Hereinafter, advantages of the present invention will be demonstrated by way of Examples, however, the present invention should not be construed with limitation of the scope thereof based on the disclosure of the Examples.

Example 1

The head of Example 1 had a structure which is identical to that of the head 2 according to the first embodiment as described above. The head main body was produced by welding of the body member with the face member. The body member was produced by casting of Ti-6Al-4V (6-4 titanium). The face member was produced by forging of DAT55G that is a titanium alloy manufactured by Daido Steel Co., Ltd. The head had a volume of 450 cc, and the club had a length of 45 inch, with the club balance being D1. For fixing the weight member, fixation by a screw structure, and adhesion with an adhesive were employed in combination. After applying the adhesive between the head main body and the weight member, the through-hole of the head main body was engaged with the projecting part of the weight member by the screw structure. The adhesive used in this step was EW2010 that is an epoxy based adhesive manufactured by Sumitomo 3M Ltd. The weight member was produced with a metal including 35% by weight tungsten, 52% by weight nickel and 13% by weight iron. The adhesive for use in the constitution of the first addition member 26 was DP-420 that is an epoxy based adhesive manufactured by Sumitomo 3M Ltd. The first addition member had a thickness T1 of 0.1 mm. The used second addition member was an aluminum alloy which had been processed to give a placoid shape. The second addition member had a thickness T2 of 1.5 mm. The weight member had a weight W3 of 12 g. The first addition member had a weight W1 of 3 g. The second addition member had a weight W2 of 1.5 g. The head weight Wh was 195 g. The first addition member had a specific gravity C1 of 1.8. An angle $\alpha$ formed by the intersection of the in-depth direction f of the recessed part with the horizontal plane h of the head reference state was 60 degree. A carbon shaft and a grip were attached to this head to obtain a golf club of Example 1. Cross-sectional view of the recessed part and therearound of the head of Example 1 is shown in FIG. 3.

Example 2

A golf club of Example 2 was obtained in a similar manner to Example 1 except that the structure of the head was changed into a structure which is the same as that of the head 34 according to the second embodiment described above. In Example 2, specifications not shown in Table 1 below are identical to those in Example 1. In Example 2, no second addition member was provided. The urethane resin member that constitutes the second layer (outermost layer) of the first addition member was produced with Elastolan XNY97A manufactured by BASF Japan Ltd. Cross-sectional view of the recessed part and therearound of the head of Example 2 is shown in FIG. 4.

Example 3

A golf club of Example 3 was obtained in a similar manner to Example 1 except that the structure of the head was changed into a structure which is the same as that of the head 44 according to the third embodiment described above. In Example 3, specifications not shown in Table 1 below are identical to those in Example 1. The first addition member had a thickness T1 of 3.5 mm. The urethane resin member that constitutes the second layer (outermost layer) of the first addition member was produced with Elastolan XNY97A manufactured by BASF Japan Ltd. The adhesive for use in construction of the first layer (first adhesive layer) and the third layer (second adhesive layer) of the first addition member was DP-420 that is an epoxy based adhesive manufactured by Sumitomo 3M Ltd. Cross-sectional view of the recessed part and therearound of the head of Example 3 is shown in FIG. 5.

Example 4

A golf club of Example 4 was obtained in a similar manner to Example 1 except that the structure of the head was changed into a structure which is the same as that of the head 58 according to the fourth embodiment described above. In Example 4, specifications not shown in Table 1 below are identical to those in Example 1. The first addition member had a thickness T1 of 3.5 mm. The urethane resin member that constitutes the second layer (outermost layer) of the first addition member was produced with Elastolan XNY97A manufactured by BASF Japan Ltd. The adhesive for use in construction of the first layer (first adhesive layer) and the third layer (second adhesive layer) of the first addition member was DP-420 that is an epoxy based adhesive manufactured by Sumitomo 3M Ltd. Cross-sectional view of the recessed part and therearound of the head of Example 4 is shown in FIG. 6.

Example 5

A golf club of Example 5 was obtained in a similar manner to Example 1 except that the structure of the head was changed into a structure which is the same as that of the head 84 according to the fifth embodiment described above. In Example 5, specifications not shown in Table 1 below are identical to those in Example 1. The first addition member had a thickness T1 of 3.5 mm. The urethane resin member that constitutes the second layer (outermost layer) of the first addition member was produced with Elastolan XNY97A manufactured by BASF Japan Ltd. The adhesive for use in construction of the first layer (first adhesive layer) and the third layer (second adhesive layer) of the first addition member was DP-420 that is an epoxy based adhesive manufactured by Sumitomo 3M Ltd. Cross-sectional view of the recessed part and therearound of the head of Example 5 is shown in FIG. 7.

Comparative Example 1

Figure 8:
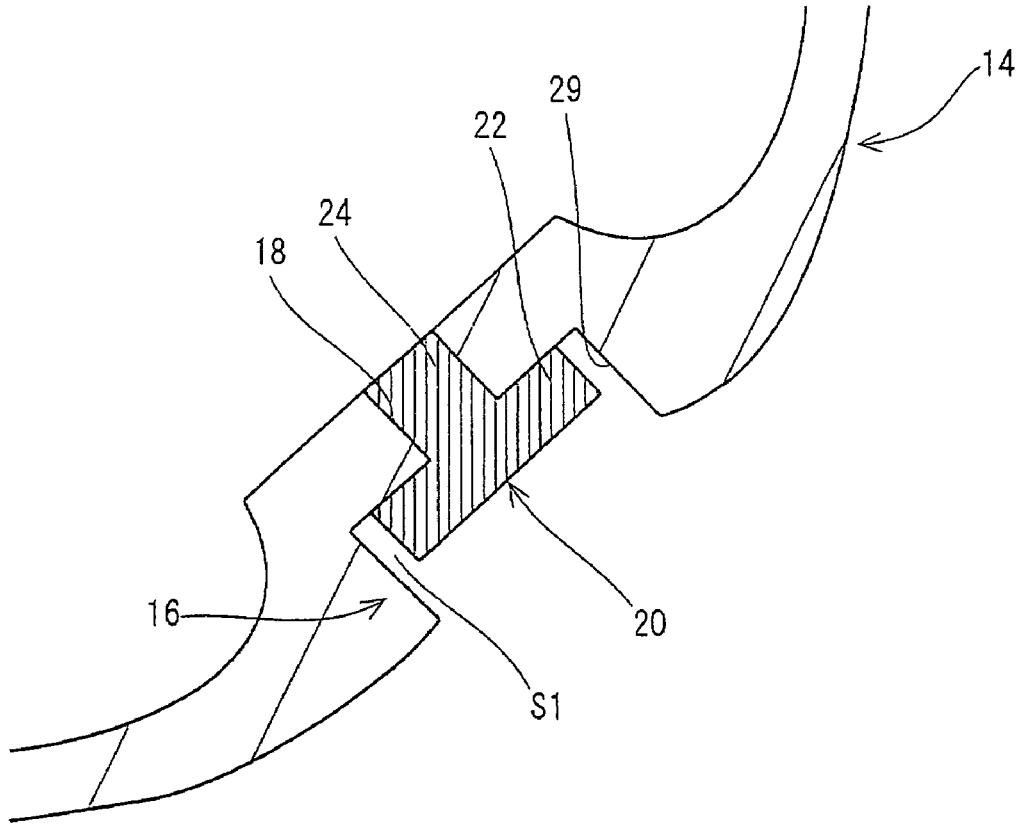
FIG. 8 is an enlarged cross-sectional view showing the recessed part and therearound of the golf club head according to Comparative Example.

A golf club of Comparative Example 1 was obtained in a similar manner to Example 1 except that the head had a structure as in Example 1 in which the first addition member and the second addition member were excluded. In Comparative Example 1, specifications not shown in Table 1 below are identical to those in Example 1. Cross-sectional view of the recessed part and therearound of the head of Comparative Example 1 is shown in FIG. 8. In FIG. 8, the parts having the same structure as those in the head 2 shown in FIG. 1 are referred to by the same reference signs in FIG. 1.

[Evaluation of Durability]

The durability was evaluated by number of hitting until any loose (jolting) is caused in the weight member. The hitting was carried out by a swing robot manufactured by Miyamae Co., Ltd. The head speed upon hitting was 55 m/s. Occurrence of loose of the weight member was observed every 500 times hitting. Results of this evaluation are shown in Table 1 below.

TABLE 1

Specifications and Results of Evaluation of Examples and Comparative Example

| | Unit | Example 1 | Example 2 | Example 3 | Example 4 | Example 5 | Comparative Example 1 |
|---|---|---|---|---|---|---|---|
| Cross-sectional view of recessed part and therearound | — | FIG. 3 | FIG. 4 | FIG. 5 | FIG. 6 | FIG. 7 | FIG. 8 |
| Presence of weight member | — | Present | Present | Present | Present | Present | Present |
| First addition member (first layer) | — | Adhesive | Adhesive | Adhesive | Adhesive | Adhesive | — |
| First addition member (second layer) | — | — | Urethane resin | Urethane resin | Urethane resin | Urethane resin | — |
| First addition member (third layer) | — | — | — | Adhesive | Adhesive | Adhesive | — |
| Second addition member | — | Aluminum alloy | — | Aluminum alloy | Aluminum alloy | Aluminum alloy | — |
| Durability | time | 18500 | 19000 | 20000 | 18000 | 17000 | 9500 |
| Thickness T1 of first addition member | mm | 0.1 | 3.5 | 3.5 | 3.5 | 3.5 | — |
| Thickness T2 of second addition member | mm | 1.5 | — | 1.5 | 1.5 | 1.5 | — |
| Weight W3 of weight member | g | 12 | 12 | 12 | 12 | 12 | 12 |
| Weight W1 of first addition member | g | 3 | 3 | 3 | 3 | 3 | — |
| Weight W2 of second addition member | g | 1.5 | — | 1.5 | 1.5 | 1.5 | — |
| Head volume V | cc | 450 | 450 | 450 | 450 | 450 | 450 |
| Head weight Wh | g | 195 | 195 | 195 | 195 | 195 | 195 |
| Specific gravity C1 of first addition member | — | 1.8 | 1.8 | 1.8 | 1.8 | 1.8 | — |
| Angle α | degree | 60 | 60 | 60 | 60 | 60 | 60 |

As shown in Table 1, the golf clubs of Examples were highly evaluated in comparison with the golf club of Comparative Example. Furthermore, the golf clubs of Examples have the first addition member and/or second addition member mounted on the external side of the weight member, therefore, they exhibit more favorable good-looking appearance in comparison with the golf club of Comparative Example. Accordingly, advantages of the present invention are clearly indicated by these results of evaluation.

In Example 5, there is a gap between the lateral face of the first addition member and the lateral face of the head main body. In other words, in Example 5, the lateral face of the first addition member does not abut the head main body. To the contrary, in Example 4, the lateral face of the first addition member abuts the head main body. By thus allowing the lateral face of the first addition member to abut the head main body, the vibration suppressing effect and vibration absorbing effect by the first addition member is improved. The existence or nonexistence of the contact of the lateral face of the first addition member with the head main body generated the difference in durability of Example 4 and Example 5.

In Example 3, the lateral face of the second addition member does not abut the head main body. To the contrary, in Example 4, the lateral face of the second addition member abuts the head main body. The absence of the contact of the lateral face of the second addition member with the head main body improves the degree of freedom of the displacement of the second addition member. High degree of freedom of the displacement of the second addition member promotes the deformation of the first addition member, thereby enhancing the vibration suppressing effect and vibration absorbing effect. The existence or nonexistence of the contact of the lateral face of the second addition member with the head main body generated the difference in durability of Example 3 and Example 4.

The description hereinabove is merely for illustrative examples, and various modifications can be made without departing from the principles of the present invention.

What is claimed is:

1. A golf club head comprising:

a head main body provided with a recessed part on the external surface thereof;

a weight member which is mounted in said recessed part and which is formed of a material having a specific gravity greater than that of the head main body, the weight member being made of an alloy;

a first addition member mounted on an external side of the weight member while abutting an external surface of said weight member, a base of said first addition member being a resin or a rubber, the first addition member being adhered to the external surface of the weight member; and a second addition member mounted on an external side of the first addition member while abutting an external surface of the first addition member, said second addition member being formed of a metal, with the specific gravity of said metal being greater than that of the first addition member and smaller than that of the weight member, the second addition member being exposed, the second addition member being adhered to the first addition member.

2. A golf club head comprising:

a head main body provided with a recessed part on the external surface thereof;

a weight member which is mounted in said recessed part and which is formed of a material having a specific gravity greater than that of the head main body, the weight member being made of an alloy;

a first addition member mounted on an external side of the weight member while abutting an external surface of said weight member, a base of said first addition member being a resin or a rubber, the first addition member being adhered to the external surface of the weight member, the first addition member being multiple-layered and including an adhesive layer and a resin layer; and a second addition member mounted on an external side of the first addition member while abutting an external surface of the first addition member, with the specific gravity being greater than that of the first addition member and smaller than that of the weight member, the second addition member being exposed, the second addition member being adhered to the first addition member.

3. The golf club head of claim 2, wherein the first addition member has a first adhesive layer on the weight member side, a second adhesive layer on the second addition member side, and a resin member disposed between the first adhesive layer and the second adhesive layer.

4. A golf club head comprising:

a head main body provided with a recessed part on the external surface thereof, a through hole being provided at a bottom face of the recessed part;

a weight member which is mounted in said recessed part and which is formed of a material having a specific gravity greater than that of the head main body, the weight member being made of an alloy, the weight member having a basal part and a projecting part protruding from the basal part, the through hole and the projecting part being engaged by a screw structure;

a first addition member mounted on an external side of the weight member while abutting an external surface of said weight member, a base of said first addition member being a resin or a rubber, the first addition member being adhered to the external surface of the weight member; and a second addition member mounted on an external side of the first addition member while abutting an external surface of the first addition member, with the specific gravity being greater than that of the first addition member and smaller than that of the weight member, the second addition member being exposed, the second addition member being adhered to the first addition member.

5. A golf club head comprising:

a head main body provided with a recessed part on the external surface thereof;

a weight member which is mounted in said recessed part and which is formed of a material having a specific gravity greater than that of the head main body, the weight member being made of an alloy;

a first addition member mounted on an external side of the weight member while abutting an external surface of said weight member, a base of said first addition member being a resin or a rubber, the first addition member being adhered to the external surface of the weight member, the first addition member having a thickness T1, wherein 0.02 mm$\leqq$T1$\leqq$4.5 mm; and a second addition member mounted on an external side of the first addition member while abutting an external surface of the first addition member, with the specific gravity being greater than that of the first addition member and smaller than that of the weight member, the second addition member being exposed, the second addition member being adhered to the first addition member, the second addition member having a thickness T2, wherein 0.5 mm$\leqq$T2$\leqq$2.5 mm.

6. A golf club head comprising:

a head main body provided with a recessed part on the external surface thereof;

a weight member which is mounted in said recessed part and which is formed of a material having a specific gravity greater than that of the head main body;

a first addition member mounted on an external side of the weight member while abutting an external surface of said weight member, a base of said first addition member being a resin or a rubber, the first addition member being adhered to the external surface of the weight member;

a second addition member mounted on an external side of the first addition member while abutting an external surface of the first addition member, said second addition member being formed of a metal, with the specific gravity of said metal being greater than that of the first addition member and smaller than that of the weight member, the second addition member being exposed, the second addition member being adhered to the first addition member; and a covering layer provided on an external surface of the second addition member.

7. The golf club head of claim 6, wherein the covering layer is a plated layer or a vapor deposited layer.

* * * * *